United States Patent [19]

Waite et al.

[11] Patent Number: 4,483,228

[45] Date of Patent: Nov. 20, 1984

[54] ROTARY CUTTER WHEEL FOR CONTINUOUS FILAMENTARY TOW

[75] Inventors: Roland Waite, Matthews; Walter J. Stikeleather, Charlotte, both of N.C.

[73] Assignee: Celanese Corporation, New York, N.Y.

[21] Appl. No.: 343,241

[22] Filed: Jan. 27, 1982

[51] Int. Cl.[3] ..... D01G 1/04

[52] U.S. Cl. ..... 83/678; 83/346; 83/699; 83/913

[58] Field of Search ..... 83/913, 663, 666, 678, 83/699, 343, 346; 19/0.6

[56] References Cited

U.S. PATENT DOCUMENTS 3,485,120 12/1969 Keith .
3,733,945 5/1973 Cook .
3,777,610 12/1973 Spaller ..... 83/913 X
3,831,481 8/1974 Van Doorn et al. .

*Primary Examiner*—Donald R. Schran
*Attorney, Agent, or Firm*—H. M. Adrian, Jr.

[57] ABSTRACT

A cutting wheel for cutting continuous filamentary tow comprises upper and lower plates rotatable about a common axis. The lower plate includes a ring-shaped section defining a central tow exit opening. An annular row of cutter blades extends between the plates, the blades having radially outwardly facing cutting edges. As filamentary tow is wrapped around the row of blades and pushed thereagainst, the tow is cut by the cutting edges and passes between the blades. A plurality of connector arms secures together the upper and lower plates. Each connector arm defines a clearance inwardly of the blade to accomodate free inward travel of tow cut by the blades. Each connector arm includes first and second segments. The first segment extends downwardly from the ring-shaped lower plate away from the plane of the latter. The second segment extends upwardly toward the upper plate and is disposed radially inwardly of the ring-shaped section of the lower plate. Crimped and uncrimped tow may be cut to lengths smaller than ½ inch and at relatively high tow speed.

8 Claims, 4 Drawing Figures

ROTARY CUTTER WHEEL FOR CONTINUOUS FILAMENTARY TOW

RELATED APPLICATION

Attention is directed to copending application Ser. No. 343,242, filed January 17, 1982 by Morton Glick.

BACKGROUND AND OBJECTS OF THE INVENTION

The invention relates to the cutting of continuous filamentary tow into staple lengths, and in particular to the cutting of crimped or uncrimped tow into lengths shorter than ½ inch.

Cutters for cutting a continuous filamentary tow of man-made fiber, such as polyester, for example, into staple lengths have been heretofore proposed. Exemplary of such proposals are the disclosures of U.S. Pat. No. 3,485,120 issued to Keith on December 23, 1969, U.S. Pat. No. 3,831,481 issued to Van Dorn et. al. on Aug. 27, 1974, and U.S. Pat. No. 3,733,945 issued to Cook on May 22, 1973.

In the Van Doorn et al patent, for example, there is disclosed in FIG. 6 a cutter wheel which comprises a pair of interconnected upper and lower circular plates which are spaced in the direction of the axis of rotation of the wheel. The wheel is provided with a circular array of cutter blades which have their ends mounted in the plates and are oriented parallel to the axis of rotation. These blades have sharpened edges facing radially outwardly and mutually spaced by a distance corresponding to the desired length of cut of the tow. Each blade is reinforced by a support post located immediately therebehind, the posts having their ends connected to the plates and thereby serving to interconnect the plates. The upper plate is rotatably driven, with rotary motion being transmitted therefrom to the lower plate primarily by the support posts. As the reel is rotated, a continuous-length tow is wrapped around the periphery of the cutting edges of the blades. As the radial thickness of the tow buildsup, a pressure roller presses the tow radially inwardly past the blades so that the tow is severed into the desired lengths. The cut tow fibers pass into the wheel and exist via a center opening in the lower plate.

One advantage of such a cutter wheel over previously employed cutters is that the frictional heat generated during the cutting action is reduced to such an extent that the need to moisten the tow prior to cutting is eliminated, as explained in afore-mentioned U.S. Pat. No. 3,485,120. That is, when using prior art cutters in which the blades are moved through the tow, frictional heat tended to fuse together fibers whose melting temperatures are reached during cutting. However, the use of a rotary cutter wheel in which the tow is pushed past a circular row of cutters has so reduced the amount of heat generated, that fusing is no longer a problem.

While such cutting wheels have performed acceptably when cutting tow into lengths longer than about ½ inch, problems have been encountered when attempting to cut uncrimped tow into lengths less than ½ inch. It has been found that the cut fibers tend to "pack" within the cutter wheel. Eventually, the packed fibers build-up to such an extent that the wheel becomes clogged and further cutting is rendered impossible. Accordingly, the cutter must be shut down and the clog removed. Such a problem has been experienced at low throughput speeds and to a greater extent at high throughput speeds such as 450 fpm tow speed.

SUMMARY OF THE INVENTION

In accordance with the present invention, the abovedescribed problems associated with the cutting of continuous filamentary tow are alleviated or eliminated by a cutting wheel which comprises first and second plates, the plates being rotatable about a common axis and being mutually spaced in the axial direction to define a space therebetween. The second plate includes a ring-shaped section defining a central tow exit opening. An annular row of cutter blades extends between the first plate and the ring-shaped section of the second plate. The blades have radially outwardly facing cutting edges such that as filamentary tow is wrapped around the row of blades and is pushed thereagainst, the tow is cut by the cutting edges and passes between the blades. A plurality of connector arms secures together the first and second plates. Each connector arm defines a clearance inwardly of the blades to accommodate free inward travel of tow cut by the blades. Each connector arm includes first and second segments. The first segment extends from the ring-shaped second plate away from the plane of the second plate in a direction opposite the first plate. The second segment extends in a direction toward the first plate and is disposed radially inwardly of the ring-shaped section.

The cutter wheel is particularly advantageous in the cutting of uncrimped tow into lengths shorter than ½ inch. Relatively high tow speeds, such as 450 fpm, for example, can be achieved.

THE DRAWING

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
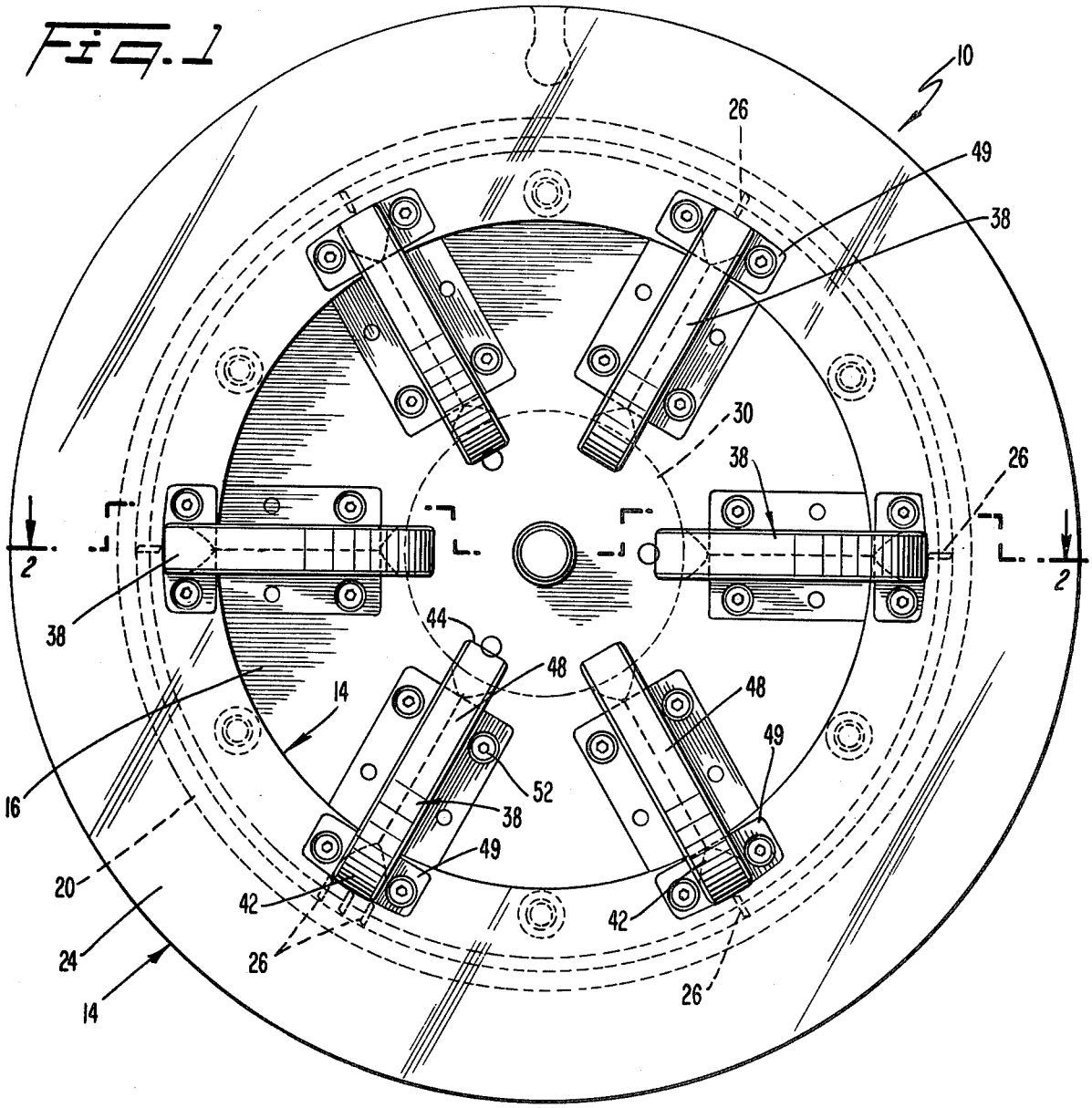
FIG. 1 is a bottom view of a cutter wheel.
Figure 2:
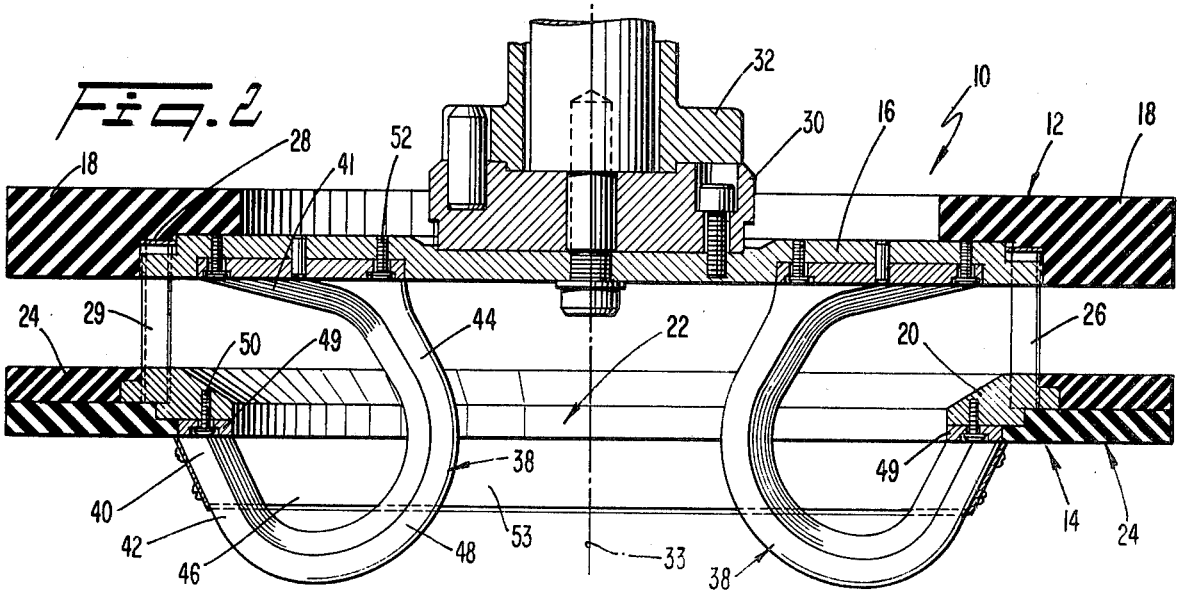
FIG. 2 is a vertical sectional view through the cutter wheel, taken along line 2—2 of FIG. 1.

As depicted in FIGS. 1 and 2, a cutter wheel 10 comprises first and second axially spaced, circular plates 12, 14. Customarily, the wheel 10 is oriented such that the plates 12, 14 are disposed in horizontal planes, the first plate 12 overlying the second plate 14. Hence, the plates will hereinafter be designated as upper and lower plates 12, 14, respectively.

The upper plate 12 comprises a metal body 16 and an outer rim 18 mounted on the outer periphery thereof by fasteners such as screws (not shown). The rim 18 is formed of a plastic material. The lower plate comprises a ring-shaped portion 20 preferably of metal which defines a large central opening 22 for the exit of cut tow. An outer rim of plastic material is secured to the outer periphery of the ring 20 and has substantially the same outer diameter as that of the outer rim 18 of the upper plate 12. The body 16 and the ring-shaped portion 20 are preferably formed of steel although other suitable materials could be employed.

A circular row of cutter blades 26 is provided. The blades 26 have their upper and lower ends mounted on radial slits in the outer peripheries of the upper and lower bodies 16, 20. The blades extend parallel to the rotary axis of the wheel, i.e., vertically during normal operation of the wheel. A rubber gasket 28 is interposed between the upper end of each blade and the associated outer ring 18 in order to prevent chattering and insure that excessive lengthwise compressive forces are not imposed upon the blades. The blades 26 are formed of a suitable tool steel, preferably an M-2 alloy and have radially outerwardly facing, sharpened edges 29.

The upper plate 12 is connected to a rotary drive (not shown) in any suitable fashion. To this end, a hub 30 is fixedly connected to the body 16 and is secured to a motor output shaft 32 such that the latter rotates the upper plate about an axis or rotation 33.

Interconnecting the upper and lower plates are a plurality of connecting arms 38. Each connecting arm 38 has a radially outer end 40 connected to the lower plate 14 and a radially inner end 41 connected to the upper plate 12.

A first segment 42 of each arm extending from the lower plate 14 extends away from the plane of the lower plate in a direction opposite the upper plate, i.e., downwardly; a a second segment 44 of each arm extends toward the upper plate, and is disposed radially inwardly of the ring 20. As a result of such an arrangement, each connecting arm 38 defines a passage or clearance 46 behind the blades 26 and inwardly of the ring 20 to accommodate passage of cut staple, whereby the interference with the flow of cut staple is minimized. Thus, even when cutting uncrimped tow to short lengths of less than ½ inch and at a high throughput rate such as 450 fpm, clogging problems are avoided which could otherwise occur if the staple was urged against a connector arm or post immediately upon being cut.

Most preferably, each arm 38 is J-shaped with a generally continuous curvature from the outer end 40 to the inner end 41. That is, the segment 42 extending from the outer end 40 has directional components away from the upper plate 12 and toward the axis of rotation. The segment 44 has similar directional components and is thus generally parallel to the portion 40. A curved intermediate segment 48 interconnects the segments 41, 44. The second segment is spaced radially from the blades 26 by a distance at least as long as the length of the blades.

The inner ends 40 of the arms 38 include feet 49 secured to the lower plate 14 by screws 50. A frustoconical section 53 may be secured to the arms 38 in surrounding relation to the exit 22. The inner ends of the arms 38 are connected to the upper plate 12 by screws 52.

Figure 3:
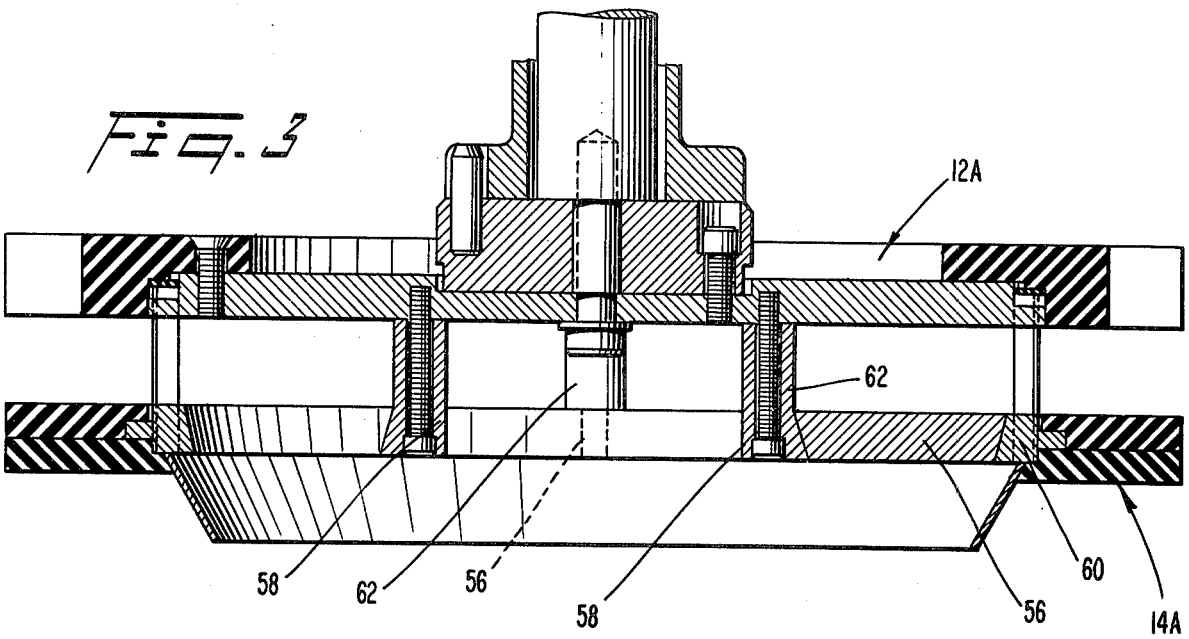
FIG. 3 is a sectional view through a non-preferred cutter wheel.

Since the radially outer section of each connector arm 38 passes downwardly away from the plane of the lower plate 14, the size of the passage 46 behind the blades 26 is enlarged as compared, for example with a non-preferred arrangement depicted in FIG. 3 wherein radial spokes 56 are provided which interconnect concentric ring-like inner and outer portions 58, 60 of a lower plate 14A. Connection between the upper and lower plates in such non-preferred embodiment is made by means of circumferentially spaced vertical posts 62 which extend between the inner ring 48 and the upper plate 12A. The advantages of inwardly recessed supports are achieved in this non-preferred embodiment, but the spokes 56, which are coplanar with the main plane of the lower plate 14A, interfere with longitudinal egress of the cut tow from the wheel. Accordingly, the cut tow may tend to pack around the spokes.

However, by offsetting the lowermost portions of the connector arms 38 from the plane of the lower plate 14, as depicted in FIG. 2, the size of the exit passage 46 is enlarged and unhindered egress of the cut tow is promoted.

Figure 4:
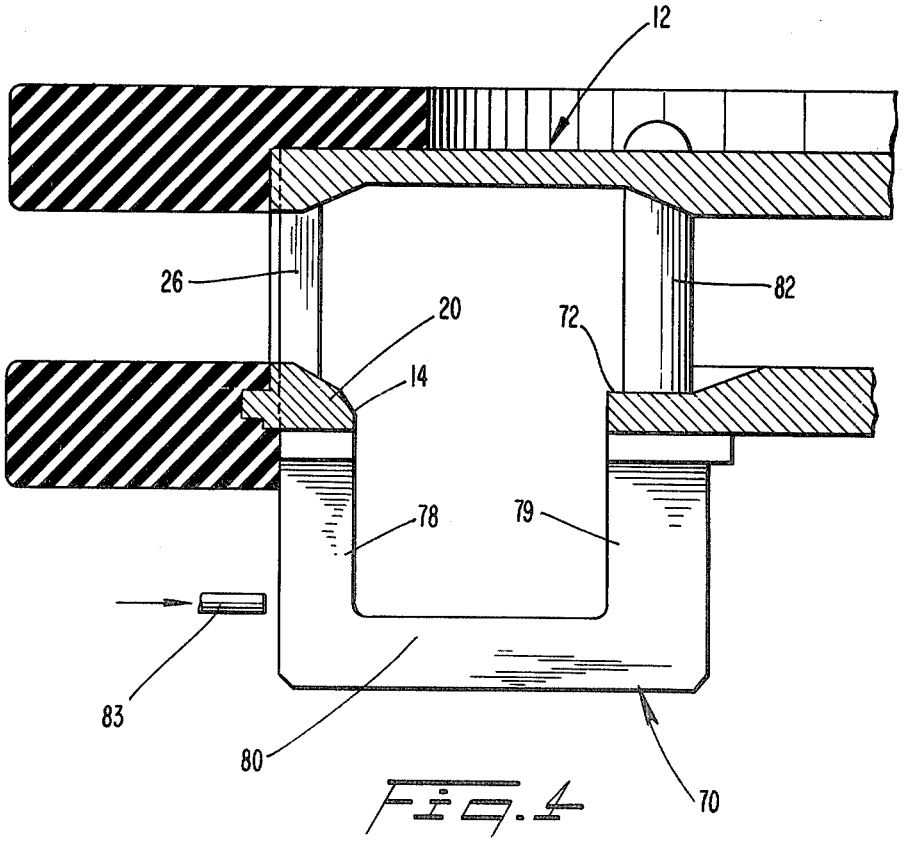
FIG. 4 is a sectional view through a portion of another preferred form of cutter wheel.

The advantages of an offset connector arm arrangement can also be achieved to a lesser extent in accordance with a less preferred cutter wheel depicted in FIG. 4. The connecting arms 70 of this embodiment have first and second segments 78, 79, the latter being spaced inwardly of the ring 20 and extending toward the upper plate 12. A third, intermediate segment 80 interconnects those segments 78, 79. The second segment 79 is connected to an intermediate annular member 72 which is spaced inwardly of the ring 20 of the second plate and is coplanar therewith. A series of longitudinal posts 82 interconnect the intermediate annular member 72 with the upper plate 12. One or more air nozzles 83 can be provided and aimed in different directions in an effort to prevent a packing of the cut tow. It will be appreciated that the presence of the intermediate annular member 72 constitutes an obstruction to travel of the cut tow. Such an obstruction has been avoided by the more preferred wheel described in connection with FIG. 2, wherein the interior space defined by the lower plate is occupied only by the connector arms themselves.

As indicated in the afore-mentioned U.S. Pat. No. 3,485,120, the lower amounts of heat generated by cutter wheels of the general type described herein has eliminated the need to pre-moisten the tow in order to prevent fusing together of the cut fibers. However, it has now been discovered that, quite surprisingly, the tendency of short cut fibers to pack within such a cutter wheel is significantly reduced if the tow is cut while in a moistened condition.

Preferably, the tow is moistened with water to a level within the range of from 1 to 18 percent moisture by weight. More preferably, the tow is moistened to at least 3 percent, and preferably no greater than about 7 percent. It should be understood that the most expedient mositure levels will vary, depending upon various factors such as the type of cutter, throughput rate, and length of cut for example.

It is not fully understood why the tendency for the fibers to pack is reduced by the moistened condition of the tow. It can be speculated, however, that the amount of expansion of the fiber mass after being cut may be reduced. The tow is cut while in a somewhat tensioned condition and thus upon being cut, the fiber mass may tend to expand in directions parallel to the plane of the blade. In this regard, when the tow is cut dry, the fiber mass assumes a "rabbit fur" characteristic and tends to more densely occupy the passage between the blades as the fiber mass passes therethrough so as to impede the travel of the fibers. If the tow is cut wet, however, the fibers may be held closer together, possibly due in part to the surface tension of the water so as to minimize the expansion of the fiber mass. Also, the moisture makes the fibers heavier and more prone to fall through the exit opening of the lower plate. In any event, the premoistening of the tow does reduce the tendency of the cut tow to pack, regardless of the particular wheel configuration. However, optimum results are achieved when premoistened tow is employed in connection with the cutter wheels described herein which, due to their particular configuration, tend by themselves to reduce the packing tendencies of the fibers.

Due to the weight of the moistened cut fibers, there results a considerable reduction of so-called fiber fly, i.e., the tendency of fibers to escape from the mechanism and become entrained in the ambient surroundings. Hence, there is less danger to the health of the operators and other personnel in the vicinity of the cutter.

IN OPERATION, the cutter wheel 10 is rotated and premoistened tow is fed thereto and wrapped around the blades 26. As the wrapped tow builds-up, a conventional pressure roll pushes the tow against and through the blades 26. The cut fibers pass through the clearance 46 formed by the connecting arms 38 and exit downwardly via the central opening 22 of the lower plate 14 for suitable collection. Virtually no packing of the cut fibers takes place and certainly not on a scale sufficient to appreciably affect the production rate.

While the cutting wheel and premoistening aspects described herein can be used in the cutting of crimped tow, or to cut tow into lengths longer than ½ inch, the primary advantages are realized when cutting uncrimped tow into lengths no greater than ½ inch, preferably ⅛ to ½ inch. The shorter the cut, the more advantageous is the present invention. Moreover, there need be no sacrifice in throughput speed since the tow can be cut at high speeds, such as 450 fpm tow speed for example.

The cutting wheel and premoistening features described herein are applicable to the cutting of any kind of filamentary material, such as nylon and acetate for example, and particularly drawn or spun polyester.

Although the invention has been described in connection with preferred embodiments of the invention, it will be appreciated by those skilled in the art that additions, modifications, substitutions, and deletions not specifically described may be made without departing from the spirit and scope of the invention as defined in the appended claims.

What is claimed is:

1. A cutting wheel for cutting continuous filamentary tow comprising:

first and second plates, said plates being rotatable about a common axis and being mutually spaced in the axial direction to define a space therebetween, said second plate including a ring-shaped section defining a central tow exit opening, an annular row of cutter blades extending between said first plate and said ring-shaped section of said second plate, said blades having radially outwardly facing cutting edges such that as filamentary tow is wrapped around said row of blades and pushed thereagainst, the tow is cut by said cutting edges and passes between said blades, a plurality of connector arms securing together said first and second plates, each connector arm defining a clearance inwardly of said blades to accommodate free inward travel of tow cut by said blades, each connector arm including:

a first segment extending from said ring-shaped section of the second plate away from the plane of said second plate in a direction opposite said first plate, and a second segment extending in a direction toward said first plate and disposed radially inwardly of said ring-shaped section.

2. A cutting wheel according to claim 1, wherein said second segment extends to said first plate.

3. A cutting wheel according to claim 2, wherein said connector arms are generally continuously curved from one said plate to the other.

4. A cutting wheel according to claim 1, wherein said second segment of said connecting arm is spaced from said annular row of blades by at least the length of said blade.

5. A cutting wheel according to claim 1, including an annular member concentric with said ring-shaped section of the second plate and spaced radially inwardly therefrom, said second segment connected to said annular element, a plurality of posts connected to said first plate and said ring annular member.

6. A cutting wheel according to claim 1 wherein said blades are spaced no greater than ½ inch apart.

7. A cutting wheel according to claim 1, wherein said first and second plates are horizontally disposed, said first plate overlying said second plate.

8. A cutting wheel for cutting continuous filamentary tow comprising:

upper and lower plates, said plates being rotatable about a common axis and being mutually spaced in the axial direction to define a space therebetween, said lower plate being ring-shaped and defining a central tow exit opening, a plurality of cutting blades extending between said plates in directions parallel to said axis, said blades having radially outwardly facing cutting edges and being arranged in an annular row so that when filamentary tow is wrapped around and pushed through said row of blades as the wheel rotates, the tow is cut by said cutting edges and the cut tow enters said space, and a plurality of connector arms interconnecting said upper and lower plates, each arm defining a clearance inwardly of said blades to accommodate free inward travel of tow cut by said blades, each connector arm including:

a first segment extending downwardly from said ring-shaped lower plate away from the plane of said lower plate, and a second segment extending upwardly to said upper plate in a direction having axial and radial outward components, said second segment disposed radially inwardly of said ring-shaped lower plate by at least the length of said blade.

* * * * *